US005960575A

United States Patent [19]

Chiovitt et al.

[11] Patent Number: 5,960,575

[45] **Date of Patent: *Oct. 5, 1999**

[54] TRIGGER GUARD LOCK FOR A FIREARM

[76] Inventors: Joseph R. Chiovitt, 65 Lower Morrisville, Fallsington, Pa. 19054; Albert H. Rogers, 4 Pennaylvannia Ave., Fairless Hills, Pa. 19030

[ * ] Notice: This patent issued on a continued prosecution application filed under 37 CFR 1.53(d), and is subject to the twenty year patent term provisions of 35 U.S.C. 154(a)(2).

[21] Appl. No.: 08/934,580

[22] Filed: Sep. 22, 1997

[51] Int. Cl.[6] ..... F41A 17/54

[52] U.S. Cl. ..... 42/70.07; 42/70.11

[58] Field of Search ..... 42/70.07, 70.11

[56] References Cited

U.S. PATENT DOCUMENTS

| | | | |
|---|---|---|---|
| 2,505,227 | 4/1950 | Charters | 42/70 |
| 3,022,596 | 2/1962 | Cannon | 42/1 |
| 3,616,559 | 11/1971 | Sobolewski | 42/1 |
| 5,283,971 | 2/1994 | Fuller | 42/70.07 |
| 5,400,538 | 3/1995 | Shannon | 42/70.06 |
| 5,450,684 | 9/1995 | Harris | 42/70.07 |
| 5,515,633 | 5/1996 | Harris | 42/70.07 |
| 5,535,605 | 7/1996 | Werner | 70/14 |
| 5,638,627 | 6/1997 | Klein | 42/70.07 |
| 5,647,158 | 7/1997 | Eskelinen | 42/70.07 |

*Primary Examiner*—Charles T. Jordan
*Assistant Examiner*—Denise J Buckley
*Attorney, Agent, or Firm*—LaMorte & Associates

[57] ABSTRACT

A trigger guard device for a firearm that prevents unauthorized access to the trigger mechanism of the firearm. The trigger guard device includes a generally U-shaped element having a first arm and a second arm that extend from a common base. A first area of elastomeric material is coupled to the first arm. Similarly, a second area of elastomeric material coupled to said second arm. The elastomeric material on both arms face across from each other. At least one mechanical fastener is provided for coupling the first arm to the second arm. Each mechanical fastener is preferably of the type that cannot be non-destructively removed once used to couple the first arm to the second arm. The first arm and the second arm are placed on opposite sides of a gun's trigger. The elastomeric material on each of the arms is then compressed against the trigger and the guard frame that surrounds the trigger, thereby securing the trigger in one set position. To remove the device, each mechanical fastener is severed, thereby releasing the side arms of the U-shaped element.

9 Claims, 6 Drawing Sheets

TRIGGER GUARD LOCK FOR A FIREARM

BACKGROUND OF THE INVENTION

1. Field of the Invention

The present invention relates to locking trigger guards for firearms that prevent a person from accessing the trigger of the firearm and firing the firearm.

2. Description of the Prior Art

Each year many accidents occur that involve a person unintentionally firing a gun. Many of these accidents involve children who do not understand the dangers created by guns. Many other accidents are caused by people playing with a loaded gun that they believe to be unloaded. Still other accidents are caused by loaded guns being dropped or the trigger of such guns being snagged on some protruding object. For all of these reasons, the prior art is replete with different types of trigger guard devices that attach to guns and prevent a person or object from accessing the trigger of that gun.

Trigger guards function by obstructing the area surrounding the trigger of the gun. By obstructing the area surrounding a trigger, a trigger becomes locked into place and cannot be moved. Most traditional trigger guards contain two opposing plates. One plate is placed on one side of the trigger while the second plate is placed on the opposite side of the trigger. A locking mechanism is then used to join the first plate to the second plate, thereby isolating the trigger. In the prior art, the locking mechanism used to join the two plates together is typically a key lock, an electronic lock or a combination lock. Combination lock trigger guards are exemplified by U.S. Pat. No. 5,638,627 to Klein, entitled Lock For Firearms With Trigger Blocking Function. Electronic lock trigger guards are exemplified by U.S. Pat. No. 5,283,971 to Fuller, entitled Trigger Guard Alarm For A Firearm. Lastly, key lock trigger guards are exemplified by U.S. Pat. No. 3,616,559 to Sobolewski, entitled Firearm Trigger Fitting On The Trigger Guard.

One feature that all of the above described prior art trigger guards share is that the trigger guards are mostly made of metal and have complex locking mechanisms. The primary reason such prior art trigger guards are made of metal is to make the trigger guard hard to remove even with a cutting tool. Since prior art trigger guards are mostly metal and contain complex locking mechanisms, such prior art trigger guards are typically expensive to manufacture.

In a gun shop or a sporting goods store, guns are commonly sold to customers. Prior to purchasing a gun, a customer typically likes to hold the gun to inspect its workings. When the gun is purchased, in some stores the gun is given to the customer to take to the cashier. Giving possession of a gun to an unknown customer can be dangerous to the employees of the gun store. Customers may carry ammunition with them into the store. Once in possession of the gun, a customer can load the gun and use that gun to rob that store.

One way to prevent this scenario from occurring is to give possession of a gun to a customer with a trigger guard in place. The customer would then not be able to operate the gun until the trigger guard is removed. With the trigger guard in place, a gun shop employee can allow a customer to handle and inspect the gun in relative safety.

The problem that exists is that a gun store would prefer to have its customers exit the gun store with the trigger guard in place on the gun that was just sold. If a typical prior art trigger guard were used, the price of the gun would have to be significantly increased to compensate for the cost of the trigger guard. Furthermore, the customer would have to be given the key or combination to the trigger guard so that the trigger guard can be removed. Giving the customer the means to remove the trigger guard in the gun store obviously defeats the original intended purpose of the trigger guard.

A need therefore exists in the art for an inexpensive trigger guard that can be applied to guns sold to the public. Such a trigger guard would enable customers to safely handle guns in gun stores and would not significantly add to the cost of the gun. A need also exists for a trigger guard that can be removed using common household tools, whereby the means to remove the trigger guard would not be available to a customer in a gun store but would be available in that person's home. These needs are met by the present invention as described and claimed below.

SUMMARY OF THE INVENTION

The present invention is a trigger guard device for a firearm that prevents unauthorized access to the trigger mechanism of the firearm. The trigger guard device includes a generally U-shaped element having a first arm and a second arm that extend from a common base. A first area of elastomeric material is coupled to the first arm. Similarly, a second area of elastomeric material coupled to said second arm. The elastomeric material on both arms face across from each other. At least one mechanical fastener is provided for coupling the first arm to the second arm. Each mechanical fastener is preferably of the type that cannot be non-destructively removed once used to couple the first arm to the second arm. The first arm and the second arm are placed on opposite sides of a gun's trigger. The elastomeric material on each of the arms is then compressed against the trigger and the guard frame that surrounds the trigger, thereby securing the trigger in one set position. To remove the device, each mechanical fastener present is severed, thereby releasing the side arms of the U-shaped element. The U-shaped element can then be removed from the trigger of the gun and the gun will function in the normal manner.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention trigger guard assembly can be attached to a variety of different shaped firearms, such as rifles, double trigger shotguns and the like, the present invention trigger guard assembly is particularly well suited for use in protecting the triggers of handguns. Accordingly, the exemplary embodiment of the present invention will be described in an application where the assembly is being used to protect the trigger of a handgun.

Figure 1:
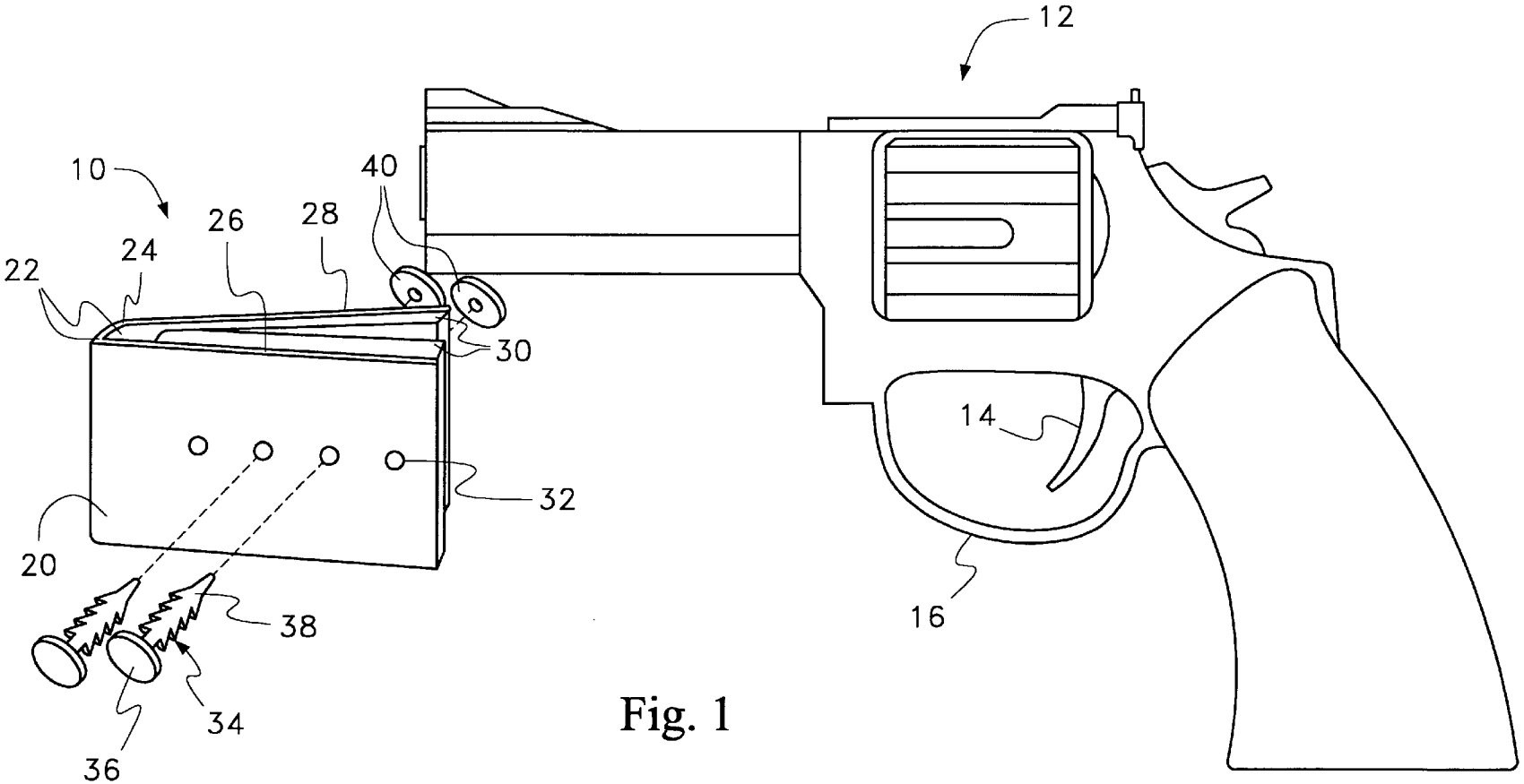
FIG. 1 is a side perspective view of one preferred embodiment of the present invention assembly shown in conjunction with a handgun to illustrate the preferred method of use for the assembly.

Referring to FIG. 1, there is shown one preferred embodiment of the present invention trigger guard assembly 10. The trigger guard assembly 10 is shown with a revolver style handgun 12. The handgun 12 has a trigger 14 extending downwardly from the frame in front of the handle. The trigger 14 is surrounded by a guard frame 16 that encircles the exposed area around the trigger 14. Such a configuration is typical of most modern handguns.

Figure 2:
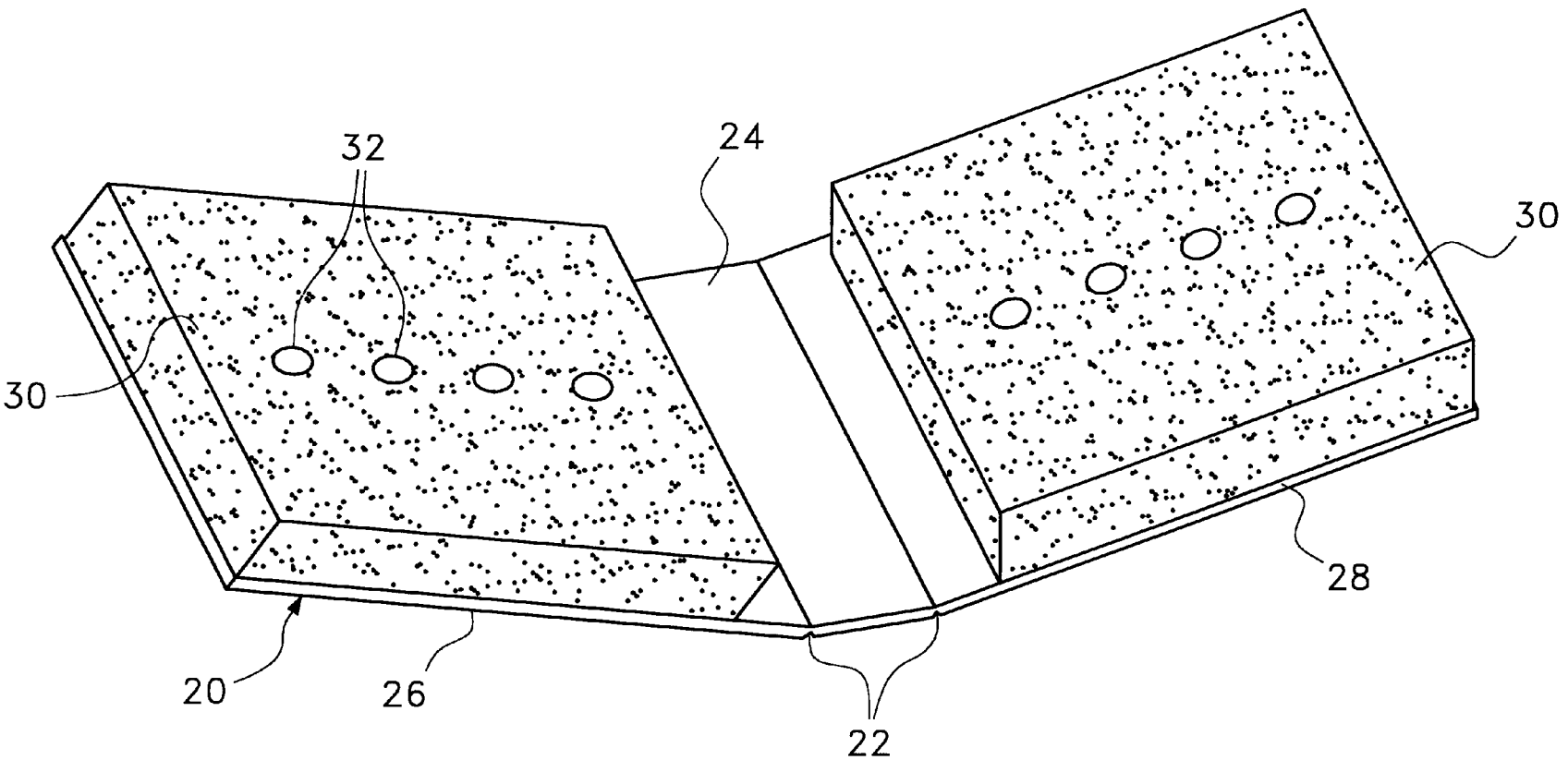
FIG. 2 is a perspective view of the embodiment of the present invention shown in FIG. 1 in an unfolded condition.

Referring to FIG. 1, in conjunction with FIG. 2, it can be seen that the trigger guard assembly 10 is comprised of a rectangular plastic backplate 20. At two points on the backplate 20, a short distance from the center of the backplate, are molded thin spots that serve as integral hinges 22. Accordingly, the rectangular backplate 20 readily bends at integral hinges 22 and the backplate 20 can be folded into a square bottomed U-shaped configuration. The integral hinges 22 divide the backplate 20 into three sections. These sections include the center section 24 in between the two integral hinges 22 and two equal side sections 26, 28 on either side of the center section 24.

Two blocks of an elastomeric material 30 are affixed to the side sections 26, 28 of the backplate 20. Both blocks of elastomeric material 30 face each other in a mirrored configuration. Consequently, when the backplate 20 is folded into a U-shaped configuration, the blocks of elastomeric material 30 oppose one another. The elastomeric material 30 can be any soft material. However, the elastomeric material is preferably material that is capable of conforming to the contours of the metal trigger 14 and guard frame 16, thereby partially surrounding these elements. Appropriate materials would include, but are not limited to, elastomeric foams, silicon impregnated foams, thermoplastic gels and the like.

A plurality of apertures 32 are formed through the side sections 26, 28 of the backplate 20. Those apertures 32 may or may not extend through the elastomeric material 30 affixed to the side sections 26, 28 of the backplate 20. When the backplate 20 is folded into a U-shaped configuration, the apertures 32 on both the side sections 26, 28 align in set pairs.

Referring back solely to FIG. 1, a one-way mechanical fastener 34 is shown. The mechanical fastener 34 is sized to pass through any of the apertures 32 in the side sections 26, 28 of the backplate 20. As will later be explained, the shaft 38 of the mechanical fastener passes through a set of apertures 32 and engages a washer 40 that is placed just outside the farther of the two apertures 32. The side sections 26, 28 therefore become compressed between the head 36 of the mechanical fastener and the washer 40 when the mechanical fastener 34 and washer 40 are applied.

To affix the present invention trigger guard assembly 10 to a handgun 12, the backplate 20 is folded into a U-shaped configuration. The guard frame 16 and trigger 14 of the handgun 12 are then passed in between the two opposing side sections 26, 28 of the backplate 20. The guard frame 16 and trigger 14 are advanced until the entire area defined by the guard frame 16 is covered. Once fully seated, the two side sections 26, 28 of the backplate 20 are manually compressed toward each other while at least one mechanical fastener 34 is passed trough a set of aperture 32 in the side sections 26, 28. If no apertures are formed in the elastomeric material 30, the mechanical fastener 34 can be forced through the elastomeric material 30 until it engages an aperture in the opposing side section of the backplate 20. As the side sections 26, 28 are compressed toward one another, the elastomeric material 30 is biased against the trigger 14 and the guard frame 16 surrounding the trigger 14. The elastomeric material 30 preferably conforms to the shape of the trigger 14 and the frame guard 16 and fills all the space surrounding the trigger 14 and the frame guard 16. The mechanical fastener 34 engages the washer on the opposite side of the device and joins the two side sections 26, 28 together. The length of the mechanical fastener is selected to maintain the elastomeric material in a compressed condition when the mechanical fastener is applied. As a result, as long as the mechanical fastener 34 is in place, the space surrounding the trigger 14 is filled with the elastomeric material 30 and the space surrounding the trigger 14 is obstructed from the sides by the side sections 26, 28 of the backplate 20.

The mechanical fastener 34 is preferably made of plastic. The mechanical fastener 34 has an enlarged head 36 and a shaft 38 with angled flanges that allow the shaft 38 to pass through backplate apertures and engage the center of a washer 40 on the opposite side of the device. As the angled flanges pass into the washer 40, the flanges prevent the mechanical fastener 34 from being pulled out of the apertures 32. There are many types of plastic mechanical fasteners 32 that are capable of being passed through an aperture and engaging a washer 40 in a manner so that it cannot be non-destructively removed. Any such known mechanical fastener 32 can be adapted for use with the present invention.

To remove the trigger guard assembly 10, the mechanical fastener 34 and/or washer 40 must be destructively removed and the backplate 20 must be unfolded away from the trigger 14. To remove the mechanical fastener 34 the head 36 or shaft 38 of the mechanical fastener 34 can be severed immediately proximate the side section of the backplate 20. Alternatively, the washer 40 may also be severed. Once either the mechanical fastener 36 or the washer 40 is severed, the mechanical fastener 34 no longer joins the two side sections 26, 28 of the backplate 20 together. The side sections 26, 28 of the backplate 20 can therefore be separated and the trigger guard assembly 10 can be removed from the handgun 12. To sever the mechanical fastener 34 and/or washer 40 a variety of common household tools can be used. Although a knife can be used, wire cutters or pliers are preferred because their use safety and cutting power. The potential of damage to the gun is also less with the use of wire cutters.

Figure 3:
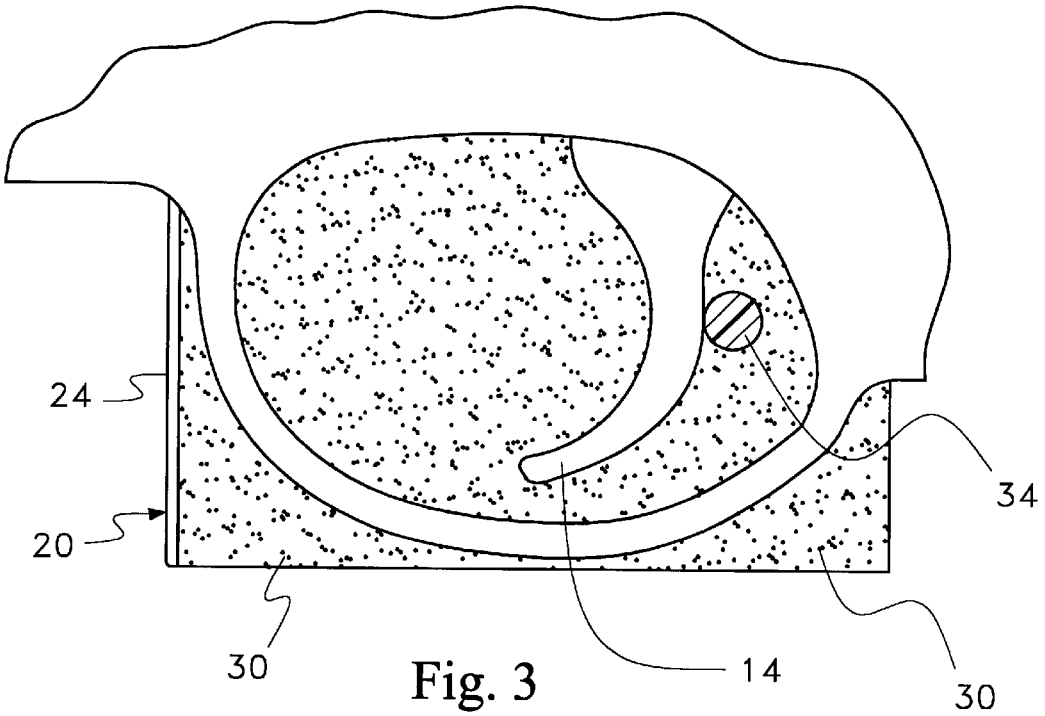
FIG. 3 is a cross-sectional view of the present invention device engaging a trigger of a gun.

In the preferred embodiment there is a plurality of apertures 32 through which one mechanical fastener 34 or multiple mechanical fasteners may pass. Accordingly, there is a variety of positions in which the mechanical fastener(s) 34 can be set. Referring to FIG. 3, it can be seen that if a space exists behind the trigger 14, the preferred placement for one of the mechanical fastener 34 is behind the trigger 14. The mechanical fastener 34 therefore acts as physical barrier to the movement of the trigger 14. This physical barrier supplements the elastomeric material 30 surrounding the trigger 14 that also prevents the trigger 14 from moving. The abutment of the center section 24 of the backplate 20 against the guard frame 16 prevents the mechanical fastener 34 from inadvertently moving out of position.

Figure 4:
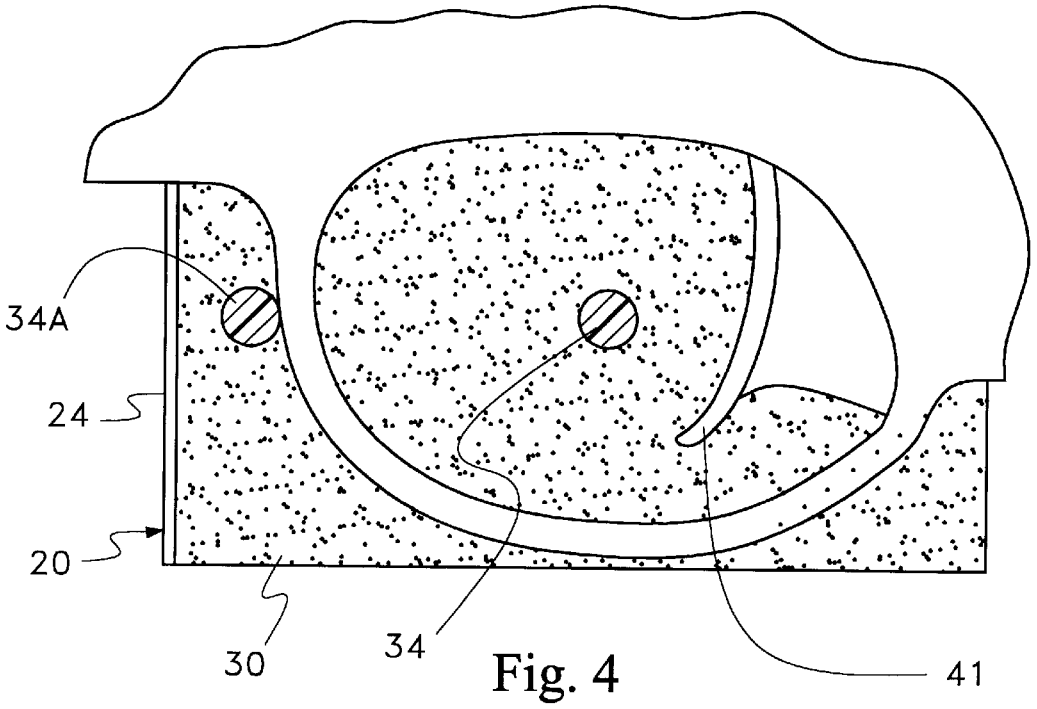
FIG. 4 is a cross-sectional view of the present invention device engaging an alternate trigger of a gun.

In many different types of guns, no space exists behind the trigger. Referring to FIG. 4, one such gun trigger 41 is shown. In such a scenario, a first mechanical fastener 34 is placed well in front of the trigger 41 so it cannot contact the trigger 41. If the center section 24 of the backplate 20 does not abut against the guard frame 16 and prevent the first mechanical fastener 34 from inadvertently contacting the trigger 41, a second mechanical fastener 34A is placed just in front of the guard frame 16. The second mechanical fastener 34A abuts against the front of the guard frame 16 and prevents the initial mechanical fastener 34 from moving toward the trigger 41.

Figure 5:
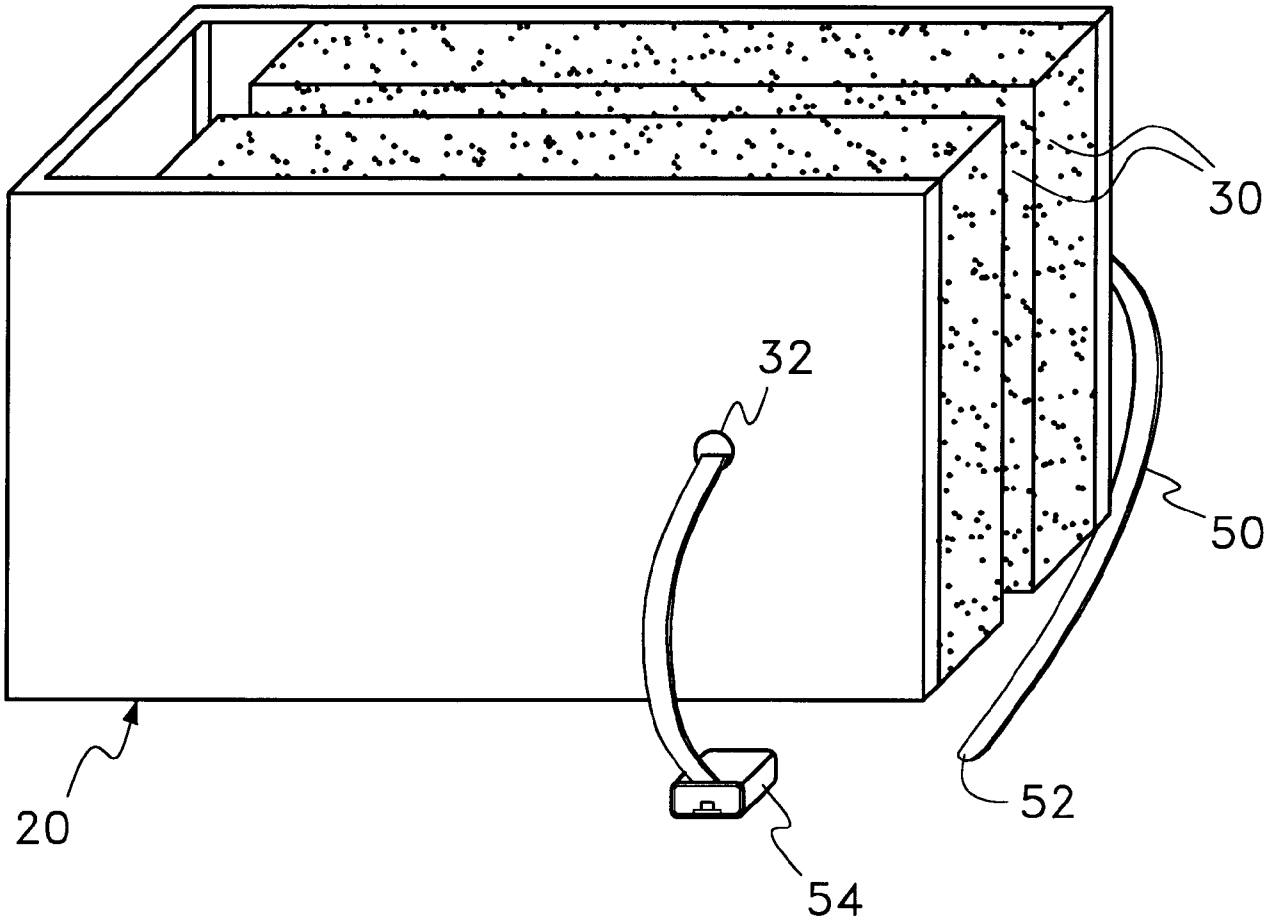
FIG. 5 is a perspective view of an alternate embodiment of the present invention device.

The use of a mechanical fastener such as that shown in FIGS. 1–4 is merely exemplary. Other mechanical fasteners can be used. Preferably the selected mechanical fastener is a one-way fastener that must be destructively removed once tightened. Referring to FIG. 5, one such alternate embodiment is shown. In this embodiment, the backplate 20 and elastomeric blocks 30 are exactly the same as previously described. However, a one-way pull tie 50 is used as the mechanical fastener. One-way pull ties 50 are widely commercially available from several different manufacturers. The tail end 52 of the pull tie 50 is advanced through the apertures 32 in the side sections of the backplate 20. The tail end 52 of the pull tie 50 is then hooked around and engaged through the head 54 of the pull tie 50. Once the tail end 52 of the pull tie 50 is pulled taut through the head 54 of the pull tie 50, the pull tie 50 biases the two side sections of the backplate 20 together. To open the backplate 20 and remove it from a gun, the pull tie 50 must be cut. By providing a pull tie 50 with a thick enough plastic, the pull tie 50 will require a tool such as scissors, wire cutters or the like to be severed.

Figure 6:
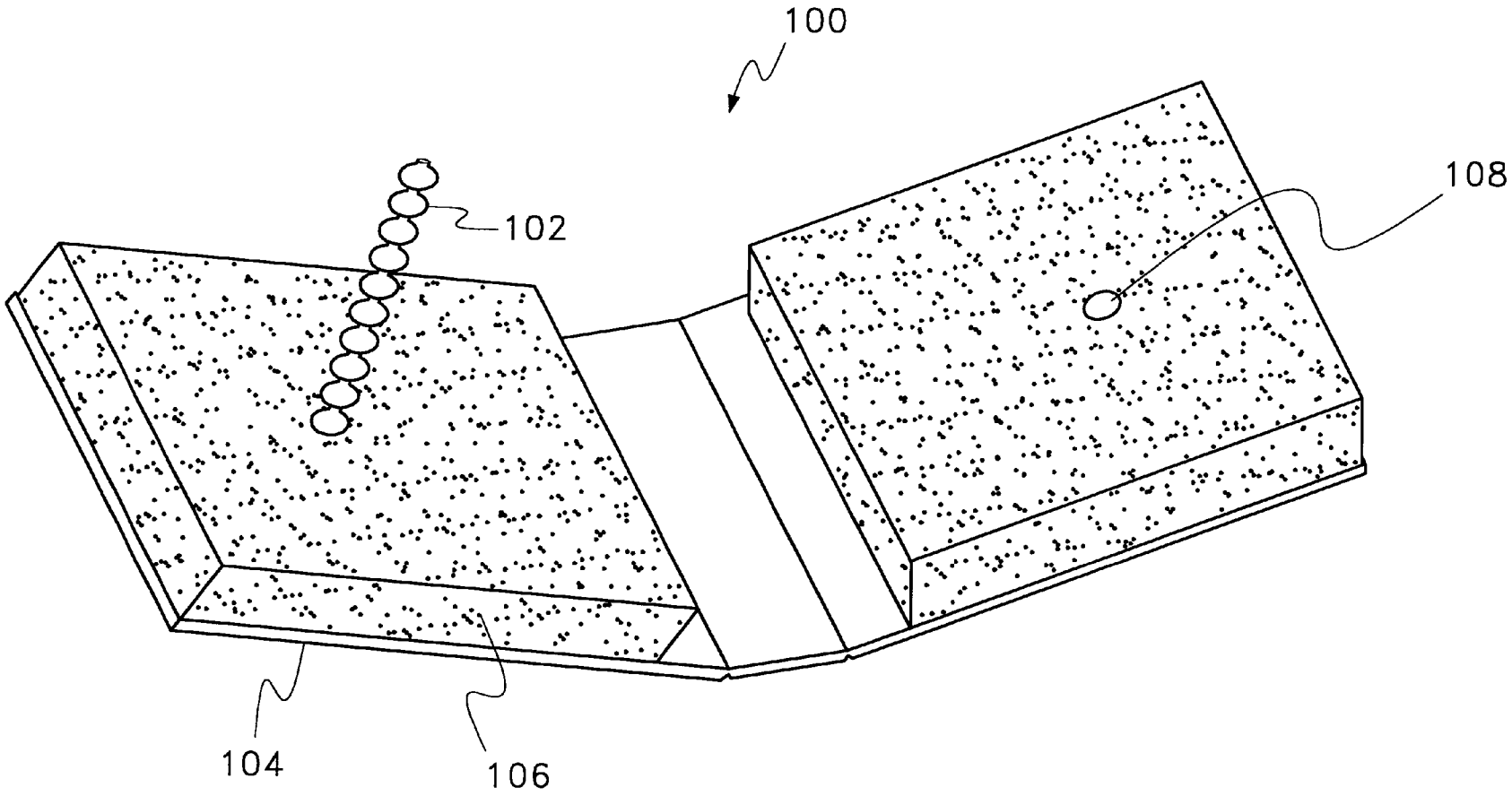
FIG. 6 is a perspective view of a second alternate embodiment of the present invention device.

Referring to FIG. 6, yet another embodiment of the present invention trigger guard device 100 is shown. In this embodiment, at least one mechanical fastener 102 is molded as part of the structure of the backplate 104. The mechanical fastener 102 extends out from one of the side sections of the backplate 104. Similarly, a washer structure (not shown) is molded as part of the structure of the backplate 104 opposite the mechanical fastener 102. The mechanical fastener 102 extends through the block of elastomeric material 106 and aligns with an aperture 108 on the opposite side plate. To apply the trigger guard device 100, the backplate 104 is folded around the trigger and guard frame of a gun. The two side plates are squeezed together until the mechanical fastener 102 passes through the aperture 108 and engages the integral washer structure on the opposite side plate. The trigger guard device is then locked into position until the mechanical fastener 102 is severed and the two side plates of the backplate 104 are again capable of being separated.

Figure 7:
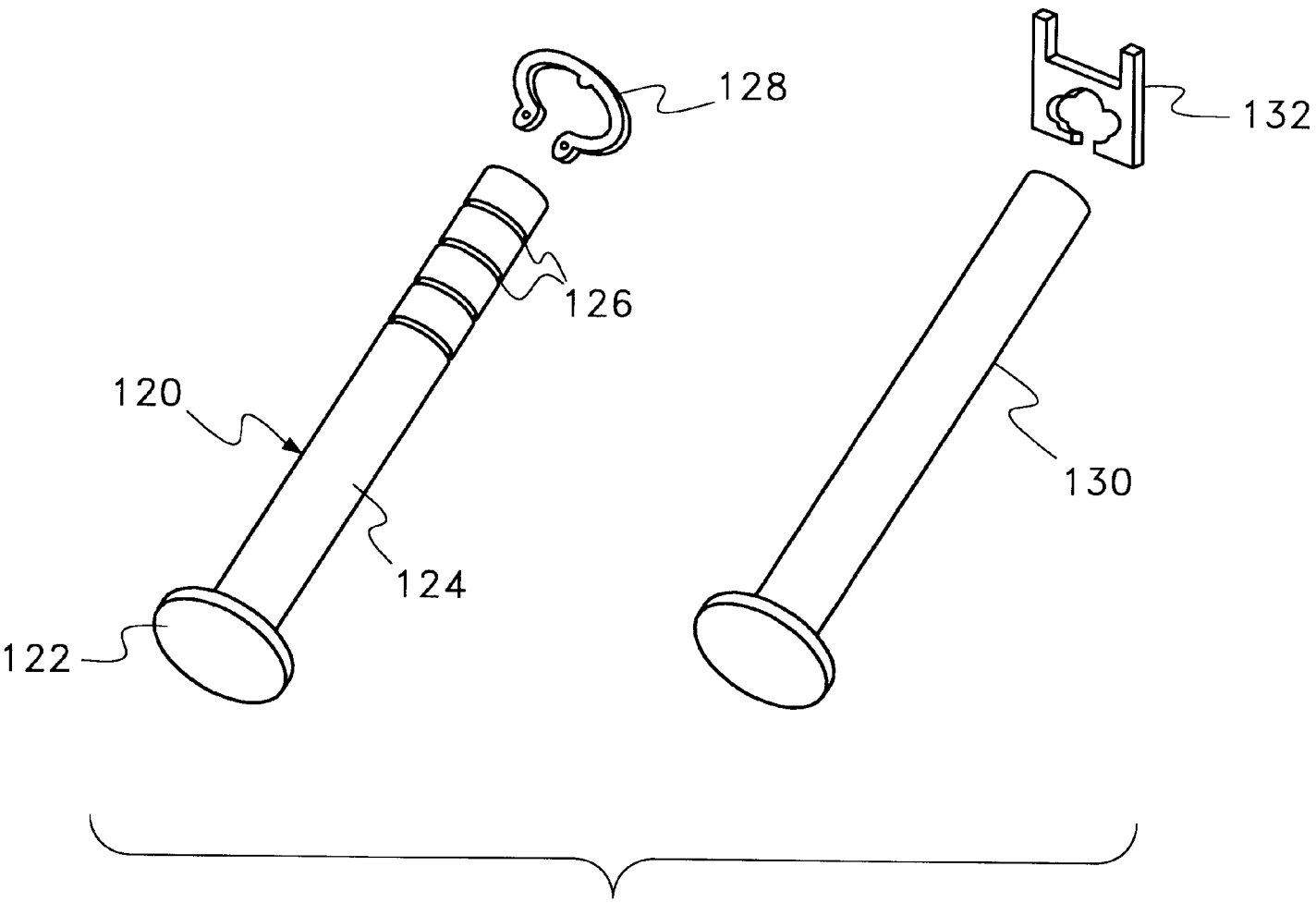
FIG. 7 is a perspective view of alternate mechanical fasteners that can be used in conjunction with the present invention device.

In the embodiment described to this point, either the mechanical fastener or the washer the fastener engages must be destructively removed in order to open the trigger guard device. It should be understood that in an alternative embodiment destructive removal need not be necessary. Referring to FIG. 7, alternate embodiments of mechanical fasteners are shown. In the first mechanical fastener, a pin 120 is used. The pin 120 has a flat head 122 at one end. The shaft 124 of the pin 120 has a plurality of grooves 126 formed along its length. A C-clip 128 is provided that is sized to engage any of the grooves 126. To remove the C-clip 128 from any one of the grooves, needle nose pliers or C-clip pliers are required to deform the C-clip 128 from its initial shape.

In the second mechanical fastener shown, a smooth shaft pin 130 is used. A pinch washer 132 is used to selectively engage the pin 130 at different points along its shaft. To remove the pinch washer, pliers are required to deform the pinch washer 132 from its initial shape.

It will be understood that the various figures described above illustrate only a few preferred embodiment of the present invention. A person skilled in the art can therefore make numerous alterations and modifications to the shown embodiment utilizing functionally equivalent components to those shown and described. All such modifications are intended to be included within the scope of the present invention as defined by the appended claims.

What is claimed is:

1. On a gun of the type having a trigger and a rigid guard frame surrounding the trigger, a method of obstructing access to the trigger of a gun, comprising the steps of:

providing a guard plate having a first plate section, a second plate section and a center plate section that joins said first plate section to said second plate section, wherein said first plate section and said second plate section both have a plurality of linearly aligned apertures disposed therethrough;

positioning said first plate section on one side of the rigid guard frame;

positioning said second plate section on the opposite side of the rigid guard frame, wherein said plurality of apertures on said first plate section align with said plurality of apertures on said second plate section, thereby creating set pairs of apertures;

bringing said central plate section into contact with the rigid guard frame;

providing a mechanical fastener, wherein said mechanical fastener includes a head and a shaft extending from said head, wherein said shaft is sized to pass through a set pair of apertures and said head is not;

placing said shaft of said mechanical fastener through one of said set pairs of apertures immediately behind the trigger, wherein said mechanical fastener engages both said first plate section and said second plate section, thereby producing a physical obstruction that connects the rigid guard frame to the trigger and prevents the trigger from moving; and passing said shaft of said mechanical fastener through at least one washer once said shaft is passed through a set pair of apertures, thereby preventing the non-destructive removal of said mechanical fastener from said set pair of apertures.

2. The method according to claim 1, wherein said mechanical fastener cannot be non-destructively removed once engaged with said first plate section and said second plate section.

3. The method according to claim 1, wherein said center section is coupled to said first plate section and said second plate section at flexible coupling points.

4. The method according to claim 3, wherein said first plate section, said second plate section and said center plate section are molded from one integral piece of plastic and said flexible coupling point are thin points in the plastic.

5. The method according to claim 1, wherein said mechanical fastener includes a plastic pull tie.

6. The method according to claim 1, wherein elastomeric material is disposed on said first plate section and said second plate section and said method further includes the step of compressing said elastomeric material in between said first plate section and said second plate section so that said elastomeric material fills the rigid guard frame surrounding the trigger.

7. The method according to claim 1, wherein said at least one mechanical fastener is plastic.

8. The method according to claim 1, wherein said first plate and said second plate are plastic.

9. The method according to claim 1, wherein said at least one washer is affixed to said second plate section.

* * * * *